US011655808B2

(12) United States Patent
Wu

(10) Patent No.: US 11,655,808 B2
(45) **Date of Patent: *May 23, 2023**

(54) VARIABLE-PRESSURE AIR PUMP

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/512,921

(22) Filed: Oct. 28, 2021

(65) Prior Publication Data

US 2022/0049688 A1 Feb. 17, 2022

Related U.S. Application Data

(63) Continuation-in-part of application No. 16/881,391, filed on May 22, 2020.

(51) Int. Cl.

| | |
|---|---|
| ***F04B 33/00*** | (2006.01) |
| ***F04B 25/02*** | (2006.01) |
| ***F04B 49/08*** | (2006.01) |
| ***F04B 27/00*** | (2006.01) |
| ***F04B 39/12*** | (2006.01) |
| ***F04B 25/00*** | (2006.01) |

(52) U.S. Cl.

CPC ..... *F04B 33/00* (2013.01); *F04B 25/005* (2013.01); *F04B 25/02* (2013.01); *F04B 27/005* (2013.01); *F04B 39/123* (2013.01); *F04B 49/08* (2013.01)

(58) Field of Classification Search

CPC .... F04B 33/005; F04B 25/02; F04B 39/0016; F04B 33/00; F04B 25/005; F04B 27/005; F04B 39/123; F04B 49/08; F04B 19/02; F04B 27/0891; F04B 9/14

USPC ..... 417/523

See application file for complete search history.

(56) References Cited

U.S. PATENT DOCUMENTS 3,981,625 A * 9/1976 Wickenberg ..... G01L 17/00 417/63
5,051,073 A * 9/1991 Newbold ..... F04B 33/005 417/527
5,443,370 A * 8/1995 Wang ..... F04B 39/0016 417/547
5,676,529 A * 10/1997 Hermansen ..... F04B 33/005 417/259

(Continued)

FOREIGN PATENT DOCUMENTS

TW 228257 8/1994

*Primary Examiner* — Kenneth J Hansen
*Assistant Examiner* — Benjamin Doyle
(74) *Attorney, Agent, or Firm* — Karin L. Williams; Alan D. Kamrath; Mayer & Williams PC

(57) ABSTRACT

A variable-pressure air pump includes a first cylinder with a first chamber and a second cylinder with a second chamber movably connected with one another. The second chamber fluidly communicable with the outside of the variable-pressure air pump selectively. A discharge device includes a connecting member and a switch movably connected with one another. The connecting member defines at least one discharge hole fluidly connecting with the second chamber. The switch has at least one flow guide portion and at least one blocking portion. The switch is movable between a first position in which the at least one flow guide portion is adjacent and opens to the at least one discharge hole and a second position in which the at least one blocking portion is adjacent to and blocks the at least one discharge hole.

9 Claims, 12 Drawing Sheets

(56) References Cited

U.S. PATENT DOCUMENTS 5,997,256 A * 12/1999 Gunther ..... F04B 33/005 417/259
6,017,201 A * 1/2000 Yang ..... F04B 25/005 417/454
6,027,316 A * 2/2000 Wang ..... F04B 25/02 137/538
6,027,319 A * 2/2000 Winefordner ..... F04B 33/005 417/440
6,120,265 A * 9/2000 Wu ..... F04B 33/005 417/526
6,135,733 A * 10/2000 Wu ..... F04B 33/005 417/469
6,190,142 B1 * 2/2001 Wu ..... F04B 33/005 417/523
6,257,849 B1 * 7/2001 Wu ..... F04B 33/005 417/469
6,270,327 B1 * 8/2001 Wolz ..... F04B 33/005 417/547
6,371,741 B1 * 4/2002 Wu ..... F04B 19/02 417/446
6,425,829 B1 * 7/2002 Julien ..... B21K 1/56 411/909
6,499,468 B1 * 12/2002 Ferraro ..... F02M 61/14 123/470
8,025,491 B2 * 9/2011 Wang ..... F04B 33/005 417/252
9,239,046 B2 * 1/2016 Wang ..... F04B 33/005
2001/0031211 A1 * 10/2001 Wu ..... F04B 33/005 417/469
2003/0156960 A1 * 8/2003 Wang ..... F04B 33/00 417/523
2003/0194329 A1 * 10/2003 Wu ..... F04B 33/005 417/63
2003/0194336 A1 * 10/2003 Wu ..... F04B 33/005 417/559
2004/0156726 A1 * 8/2004 Wu ..... F04B 33/005 417/469
2004/0253914 A1 * 12/2004 Becksvoort ..... B24B 33/08 451/478
2008/0223568 A1 * 9/2008 Roggeband ..... E21B 43/105 166/55
2009/0175747 A1 * 7/2009 LeBoeuf ..... F04B 33/00 417/545
2009/0285697 A1 * 11/2009 Sorensen ..... F04B 5/02 417/523
2010/0104453 A1 * 4/2010 Wu ..... F04B 33/005 417/63
2011/0091339 A1 * 4/2011 Huang ..... F04B 33/005 417/437
2011/0280756 A1 * 11/2011 Huang ..... F04B 33/005 417/559
2012/0192993 A1 * 8/2012 Chuang ..... F04B 33/005 141/351
2012/0234401 A1 * 9/2012 Wu ..... F16L 37/00 137/231
2013/0087040 A1 * 4/2013 Schwiertz ..... F04B 53/22 92/169.1
2013/0101453 A1 * 4/2013 Chuang ..... F04B 33/005 417/521
2013/0136625 A1 * 5/2013 Chuang ..... F04B 33/005 417/234
2014/0180210 A1 * 6/2014 Niklaus ..... A61M 5/1452 604/152
2016/0010637 A1 * 1/2016 Chuang ..... F04B 33/00 417/63
2016/0231185 A1 * 8/2016 Wu ..... F04B 53/14
2016/0312772 A1 * 10/2016 Chuang ..... F04B 33/005
2017/0167477 A1 * 6/2017 Hermansen ..... F04B 39/14
2018/0010592 A1 * 1/2018 Chuang ..... F04B 33/005
2018/0340524 A1 * 11/2018 Wang ..... F04B 33/00
2019/0203793 A1 * 7/2019 Deman ..... A47K 5/1205
2019/0309824 A1 * 10/2019 Jackson ..... F16G 11/108
2020/0056601 A1 * 2/2020 Wu ..... F04B 33/005
2020/0300232 A1 * 9/2020 Wang ..... F04B 29/00
2020/0300233 A1 * 9/2020 Wang ..... F04B 25/02

* cited by examiner

VARIABLE-PRESSURE AIR PUMP

CROSS REFERENCE

This application is a continuation-in-part of U.S. application Ser. No. 16/881,391, filed on May 22, 2020, which is incorporated herein by reference.

BACKGROUND OF THE INVENTION

1. Field of the Invention

The present invention relates to an air pump and, particularly, to a variable-pressure air pump.

2. Description of the Related Art

It is noticed that all existing air pumps try to focus on improving inflation efficiency, but no matter how the efficiency is improved, the cross-sectional areas of cylinders are inversely proportional to the pressure, so it is impossible to improve the inflation rate and the inflation effect at the same time.

Taiwan Pat. No. 228257 discloses an air pump convertible between a first mode for outputting high volume of air and a second mode for outputting high-pressure air. The air pump includes two cylinders being operable between a first mode in which the first and the second cylinders move relative to one another to output high volume of air to quickly inflate an object, and a second mode in which the second cylinder does not move relative to the first cylinder to output high-pressure air.

Generally, a user grasps on a head of the pump with one hand and a handle of the pump with the other hand upon operating the pump. However, when the pump is directly connected to a valve of a tire to be inflated, it is noted that the user is unable to hold the head conveniently and operate the pump smoothly.

The present invention is, therefore, intended to obviate or at least alleviate the problems encountered in the prior art.

SUMMARY OF THE INVENTION

According to the present invention, a variable-pressure air pump includes a first cylinder and a second cylinder movably connected with one another. The first cylinder defines a first chamber. The second cylinder defines a second chamber fluidly communicable with the outside of the variable-pressure air pump selectively. A plunger has a first end inserted in the first chamber and a second end inserted in the second chamber. The plunger defines a one-way flow passage fluidly connecting with the first and the second chambers. A piston device is configured to compress air in the first and the second chambers. A discharge device includes a connecting member and a switch movably connected with one another. The connecting member defines at least one discharge hole fluidly connecting with the second chamber. The switch has at least one flow guide portion fluidly connecting with the outside of the variable-pressure air pump and at least one blocking portion which is adapted to block the at least one discharge hole. The switch is movable between a first position in which the at least one flow guide portion is adjacent and opens to the at least one discharge hole and a second position in which the at least one blocking portion is adjacent to and blocks the at least one discharge hole. The discharge device is disposed at an end opposite to an end of a head assembly of the variable-pressure air pump.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
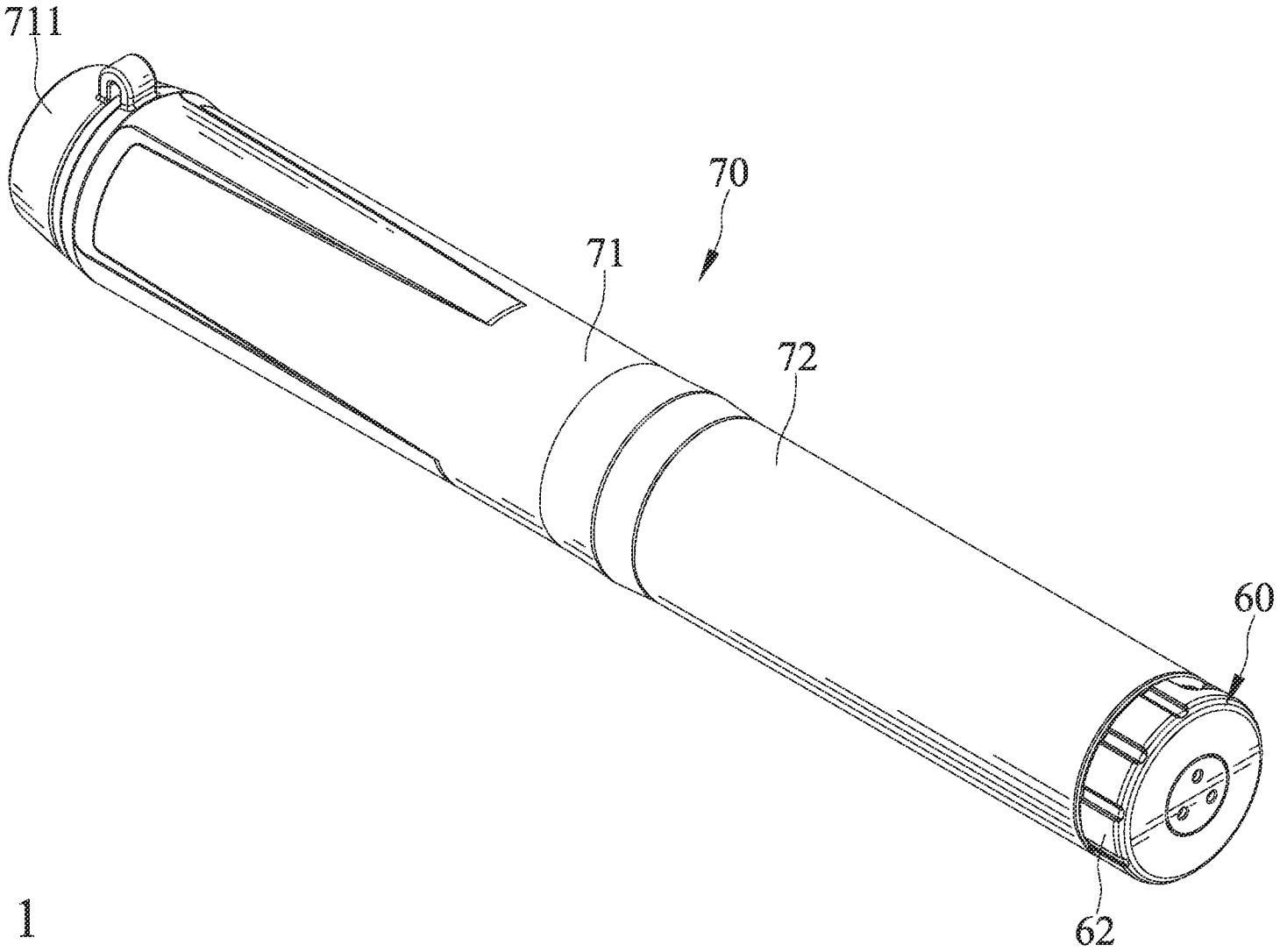
FIG. 1 is a perspective view of a variable-pressure air pump in accordance with a first embodiment of the present invention.
Figure 2:
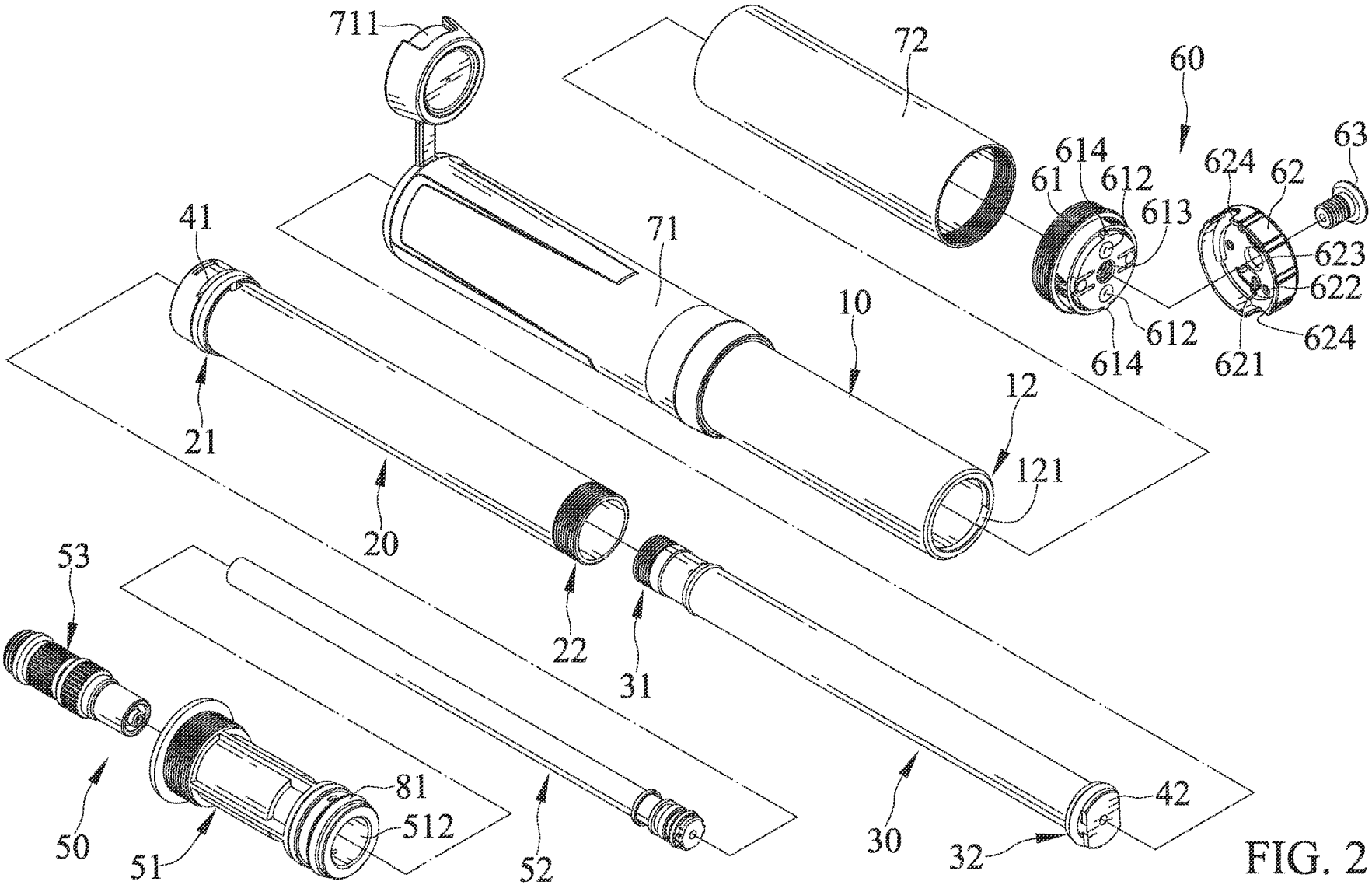
FIG. 2 is an exploded perspective view of the variable-pressure air pump of FIG. 1.
Figure 3:
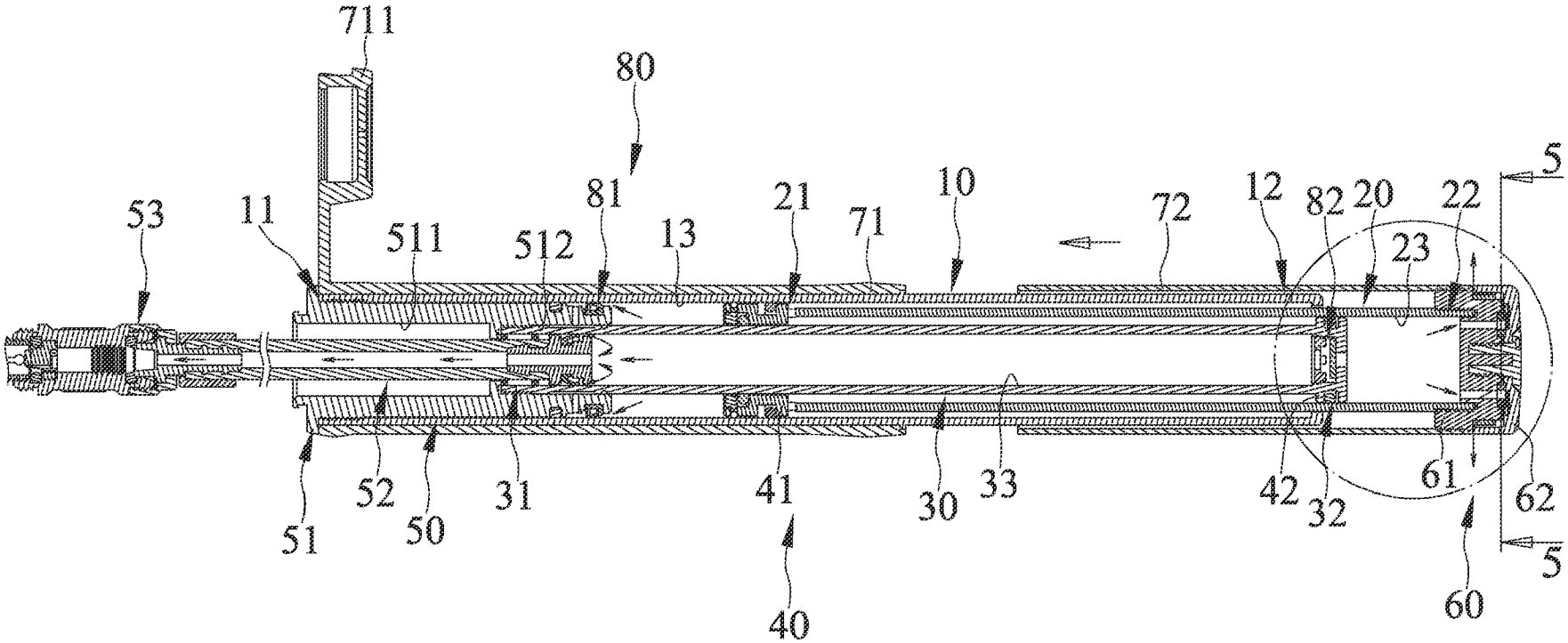
FIG. 3 is a cross-sectional view illustrating the operation of the variable-pressure air pump of FIG. 1, with a switch thereof in a first position.
Figure 4:
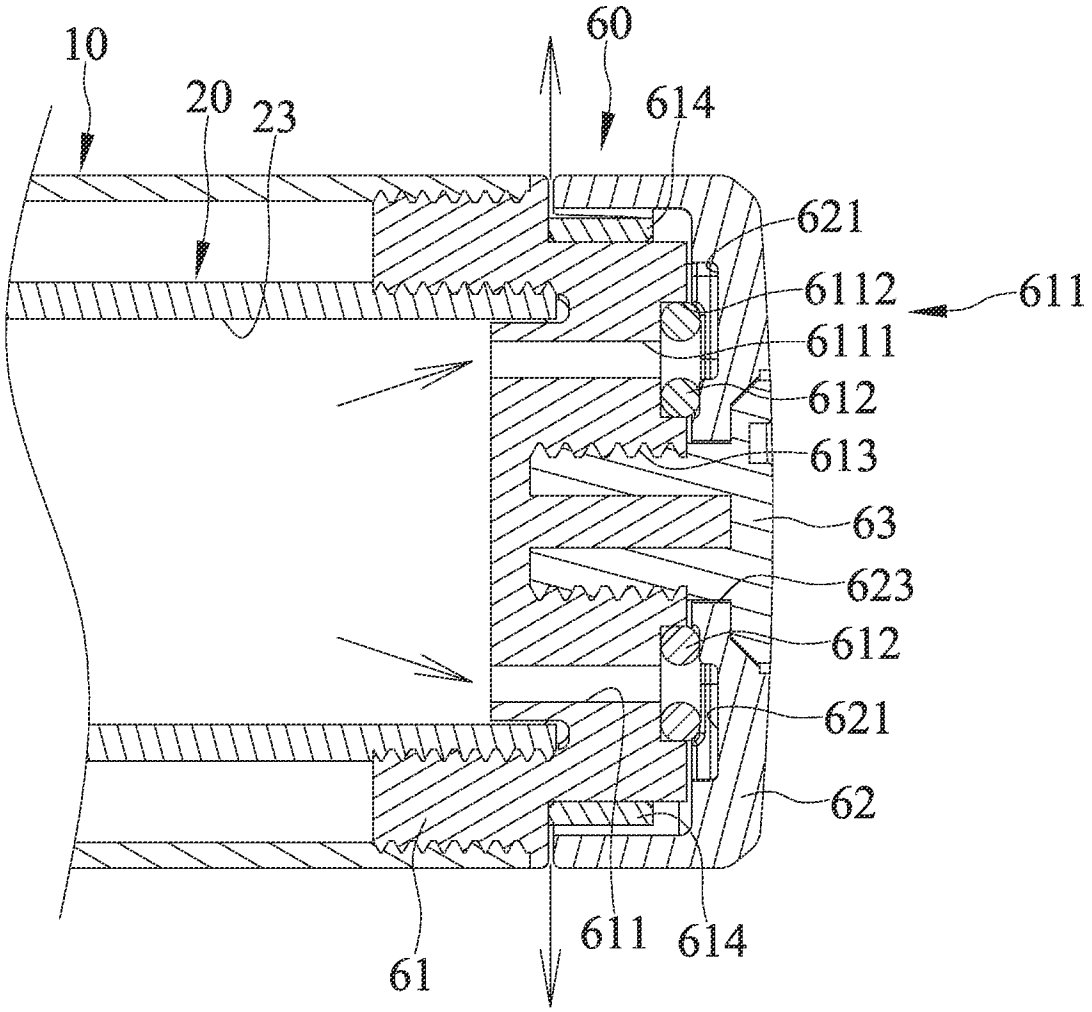
FIG. 4 is a partial, enlarged cross-sectional view of FIG. 3.
Figure 5:
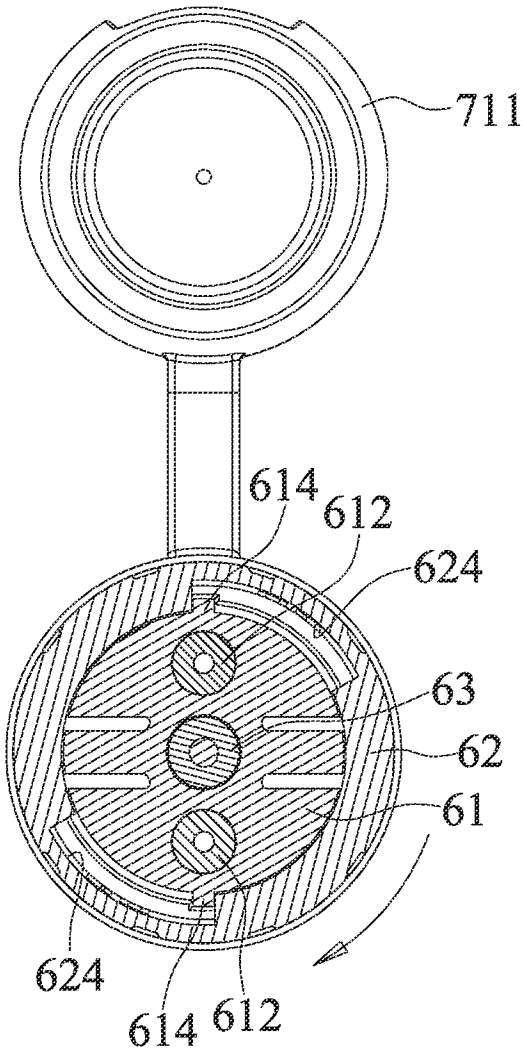
FIG. 5 is a cross-sectional view taken along line 5-5 of FIG. 4, with an arrow representing an operational movement.
Figure 6:
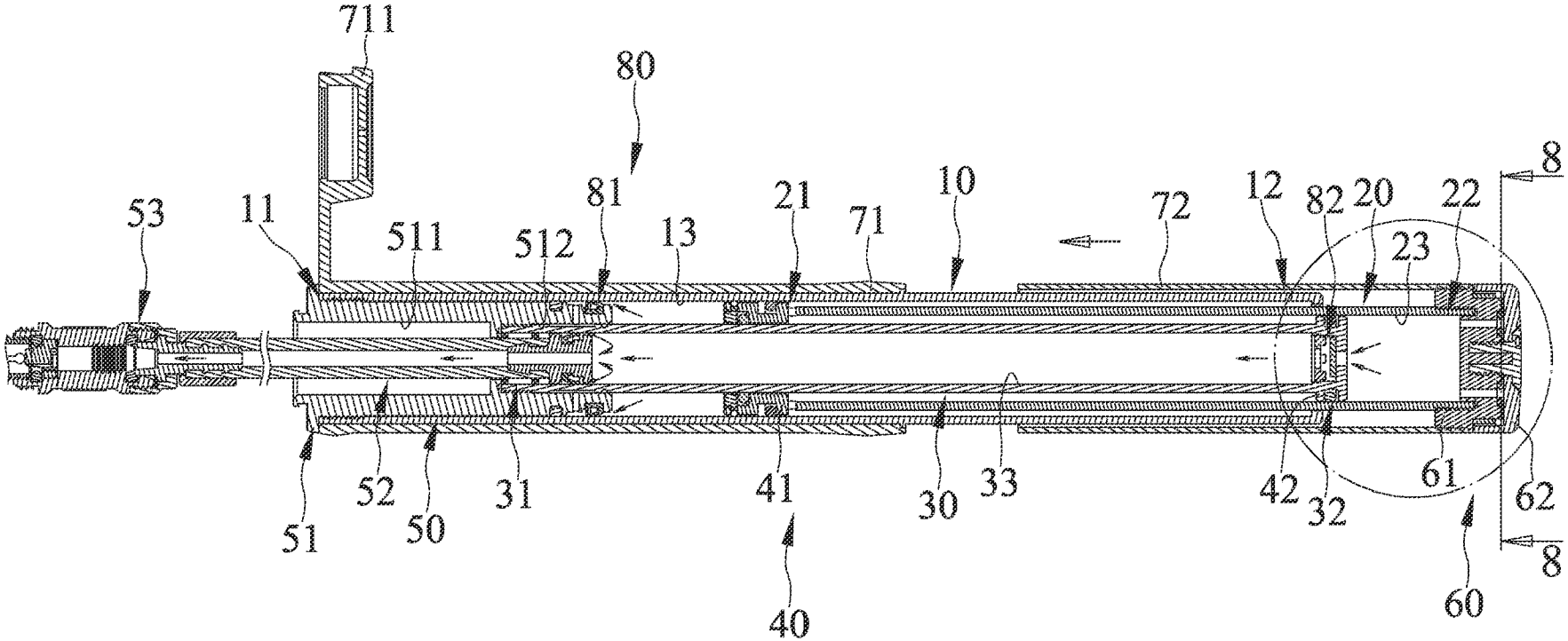
FIG. 6 is a cross-sectional view illustrating the operation of the variable-pressure air pump of FIG. 1, with the switch thereof in a second position.
Figure 7:
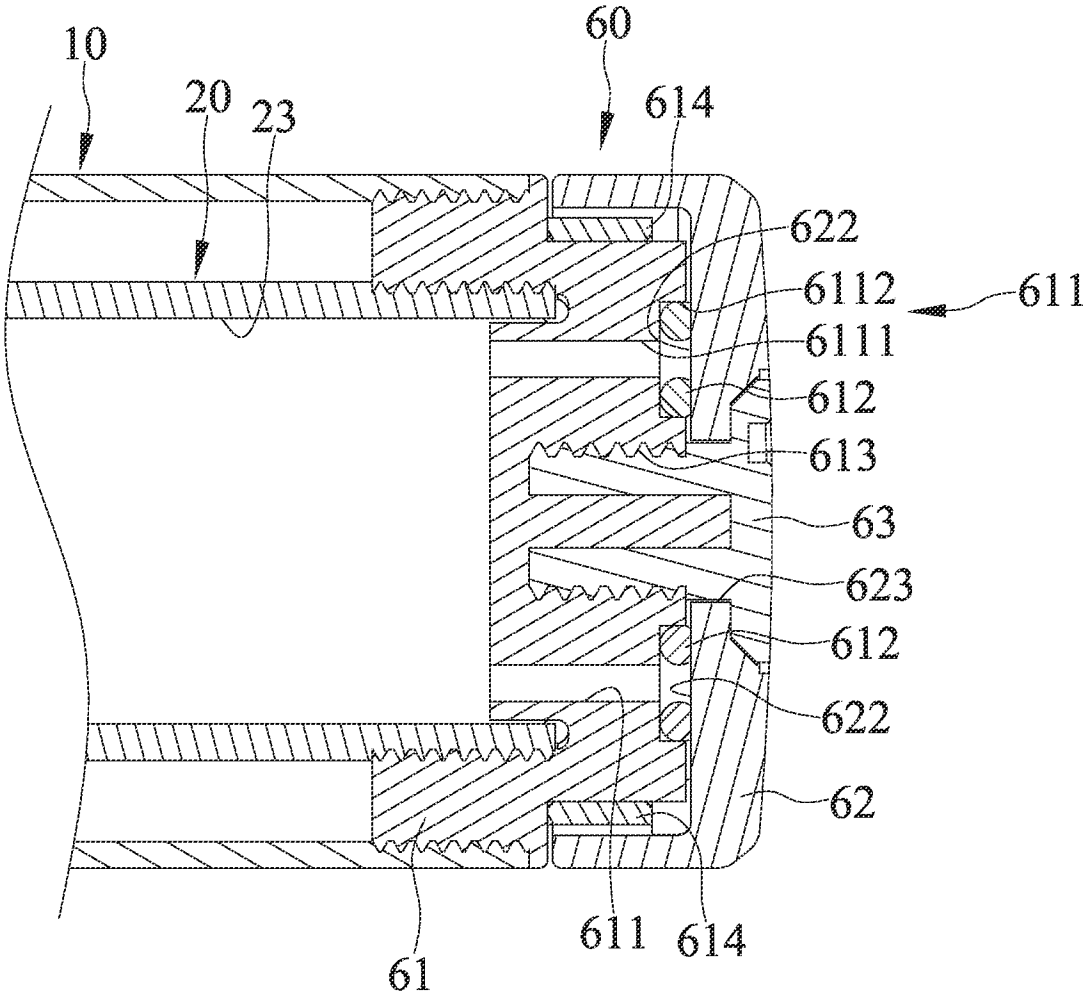
FIG. 7 is a partial, enlarged cross-sectional view of FIG. 6.
Figure 8:
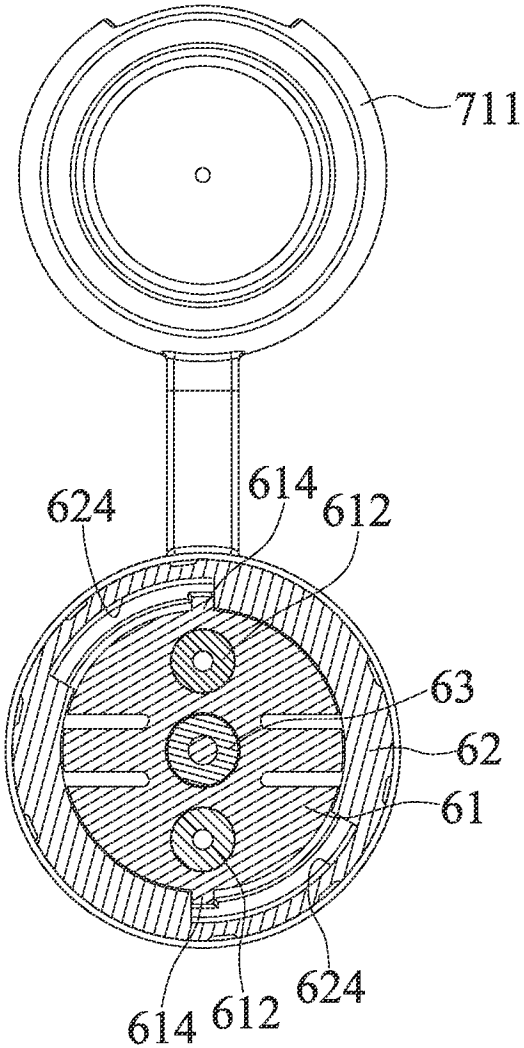
FIG. 8 is a cross-sectional view taken along line 8-8 of FIG. 6.

FIGS. 1-8 show a variable-pressure air pump in accordance with a first embodiment of the present invention.

A cylinder 10 defines a chamber 13 and at least one channel 121 that allows air to flow into the chamber 13. The cylinder 10 extends longitudinally from an end 11 to an end 12. The at least one channel 121 extends from the chamber 13. The at least one channel 121 defines an opening at the end 12.

A cylinder 20 is movably connected with the cylinder 10. Air in the chamber 13 when the cylinder 20 moves relative to the cylinder 10. The cylinders 10 and 20 are disposed coaxially and the move relative to one another in an axial direction. The cylinder 20 defines a chamber 23. The chamber 23 is fluidly communicable with the outside of the variable-pressure air pump selectively. The cylinder 20 is disposed coaxially with the cylinder 10. The cylinder 20 has an end 21 and an end 22 disposed oppositely.

A plunger 30 has an end 31 inserted in the chamber 13 and another end 32 inserted in the chamber 23. The end 32 is opposite to the end 31. The plunger 30 defines a one-way flow passage 33 fluidly connecting with the chambers 13 and 23.

A piston device 40 is configured to compress air in the chambers 13 and 23. The piston device 40 includes a piston 41 configured to compress air in the chamber 13 and a piston 42 configured to compress air in the chamber 23 respectively. The piston 41 is connected with the cylinder 20 and is movably disposed in the chamber 13. The piston 41 is fixedly connected at the end 21 of the cylinder 20. The piston 41 moves in the chamber 13 upon relative movement of the cylinders 10 and 20. The piston 42 is connected with the plunger 30 and movably disposed in the chamber 23. The piston 42 is fixedly connected at the end 32 of the plunger 30. The piston 42 moves in the chamber 23 upon relative movement of the cylinders 10 and 20.

A head assembly 50 is configured to engage with an object to be inflated. The head assembly 50 includes a hose 52 and a valve adapter 53 fluidly connecting with one another. The hose 52 is adapted to move between an extended position and a retracted position. The hose 52 is selectively receivable by and fluidly connects with the flow passage 33. The hose 52 is disposed coaxially with the plunger 30. The hose 52 and the plunger 30 move relative to one another in an axial direction. The hose 52 is flexible and, therefore facilitates connection of the variable-pressure air pump with an object to be inflated easily and the pumping operation. The valve adapter 53 is configured to connect with an object to be inflated. Specially, the valve adapter 53 can fluidly connect with a valve of the object to be inflated. The head assembly 50 also includes a head 51 adapted to prevent air from flowing therethrough and out of the chamber 13. The head 51 is connected with the cylinder 10. The head 51 and the cylinder 10 have threads engaged with one another. The head 51 is also connected with the plunger 30. The head 51 and the plunger 30 have threads engaged with one another. The piston 42 and the head 51 are connected with the plunger 30 oppositely. Moreover, the head 51 defines a compartment 511 adapted to receive the valve adapter 53 selectively and a compartment 512 with which the end 31 of the plunger 30 is engaged. When the hose 52 is retracted in the flow passage 33, the valve adapter 53 is stored in the compartment 511.

A discharge device 60 is disposed at an end opposite to an end of a head assembly 50 of the variable-pressure air pump. The discharge device 60 is connected with the cylinder 20. The discharge device 60 is connected at the end 22 of the cylinder 20. The connecting member 61 and the cylinder 20 have threads engaged with one another. The discharge device 60 includes a connecting member 61 and a switch 62 movably connected with one another. The switch 62 is fastened to the connecting member 61 by a fastener 63. The connecting member 61 and the switch 62 respectively defines a hole 613 and a hole 623 and the fastener 63 is inserted through the hole 623 and engaged with the hole 613. The fastener 63 and the hole 613 have threads engaged with one another. The at least one discharge hole 611 and the hole 613 extend longitudinally parallel to each other.

The connecting member 61 and the piston 41 are connected with the cylinder 20 oppositely. The connecting member 61 defines at least one discharge hole 611 fluidly connecting with the chamber 23. The switch 62 is configured to selectively prevent the chamber 23 from fluidly connecting with the outside of the variable-pressure air pump. The switch 62 has at least one flow guide portion 621 fluidly connecting with the outside of the variable-pressure air pump and at least one blocking portion 622 adapted to block the at least one discharge hole 611. The switch 62 is movable between a first position in which the at least one flow guide portion 621 is adjacent and opens to the at least one discharge hole 611 and a second position in which the at least one blocking portion 622 is adjacent to and blocks the at least one discharge hole 611. The air pump can discharge air through the at least one discharge hole 611 when the switch 62 in the first position. The connecting member 61 and the switch 62 have a space therebetween filled by at least one seal 612. When the at least one blocking portion 622 is adjacent to and blocks the at least one discharge hole 611, the at least one seal 612 and the at least one blocking portion 622 abut against one another. The at least one discharge hole 611 has a small section 6111 and a large section 6112 and the at least one seal 612 is retained in the large section 6112.

The connecting member 61 has two limits 614 configured to obstruct movement of the switch 62. The switch 62 in the first position thereof is obstructed by one of the two limits 614. The switch 62 in the second position thereof is obstructed by the other of the two limits 614. The switch 62 defines two grooves 624. The two limits 614 are movably engaged in the two grooves 624 respectively and move therein upon moving the switch 62 with respect to the connecting member 61. The two limits 614 protrude from an outer surface of the connecting member 61. The two limits 614 protrude radially from the outer surface of the connecting member 61. The switch 62 is rotatably connected with the connecting member 61 and each of the two grooves 624 extends curvedly.

A shell assembly 70 is configured to be grasped when operating the variable-pressure air pump. The shell assembly 70 includes a sleeve 71 connected with the cylinder 10 and a sleeve 72 connected with the connecting member 61 respectively. The cylinder 10 has a portion disposed outside the sleeve 71 being selectively receivable by the sleeve 72.

The cylinder 20 and the sleeve 72 move together upon moving the cylinder 20 with respect to the cylinder 10.

The shell assembly 70 also includes a cap 711 configured to close an opening of the head assembly 50. Specifically, the cap 711 is used to close an opening of the compartment 511 of the head 51. More specifically, the cap 711 can close the opening of the compartment 511 when the valve adapter 53 is stored in the first compartment 511. The cap 711 and the sleeve 71 are made integrally. Specifically, the cap 711 and the sleeve 71 are made in one piece.

A one-way flow device 80 is configured to allow air to flow in one direction and inhibit air passing through from flowing in an opposite direction. The one-way flow device 80 includes a one-way valve 81 disposed between the head 51 and a wall delimiting the inner chamber 13. The one-way flow device 80 also includes a one-way valve 82 disposed on the piston 42 and within the flow passage 33. Specifically, the one-way valve 81 is disposed between an outer periphery of the head 51 and an inner wall of the cylinder 10.

Figure 9:
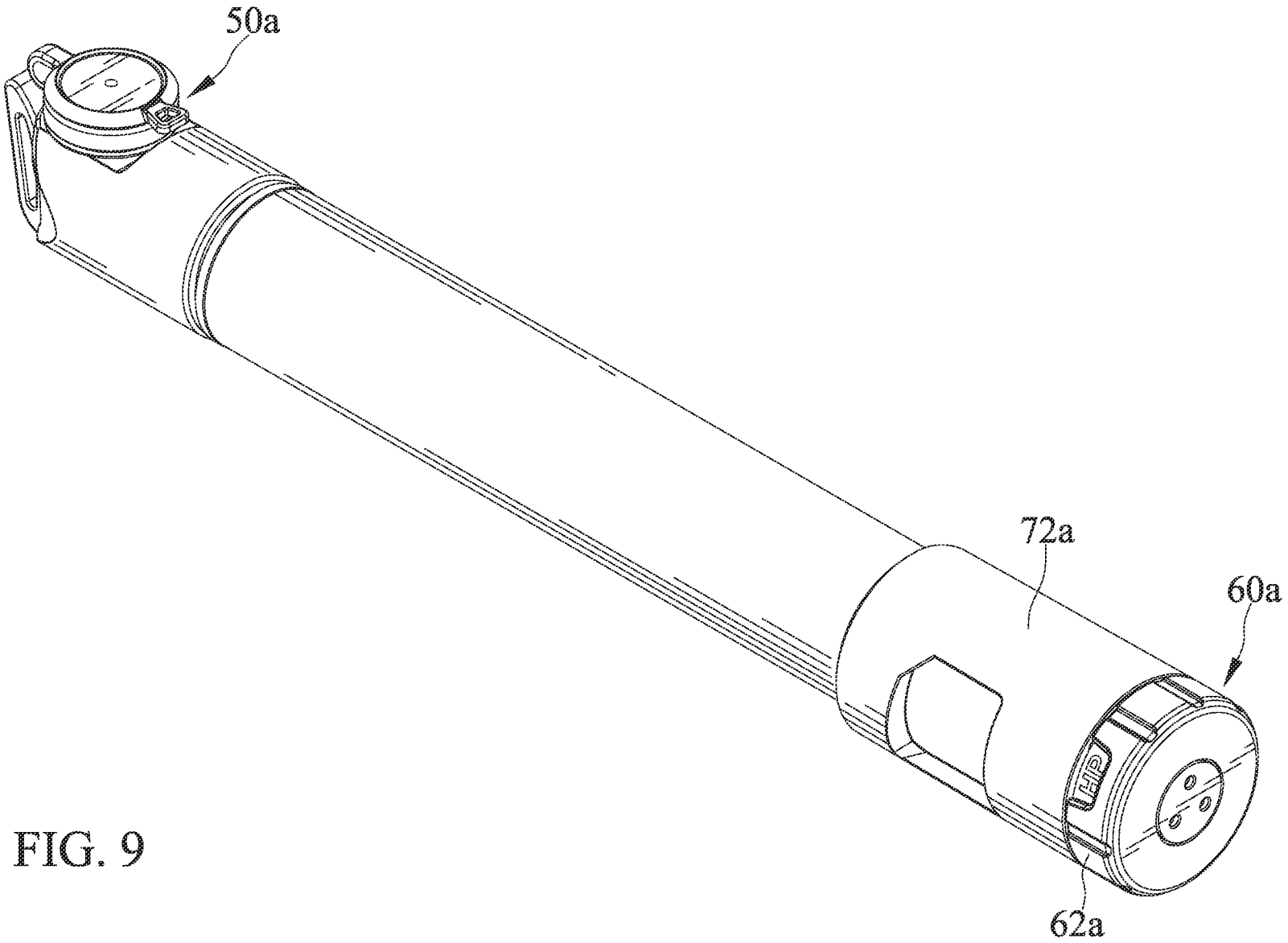
FIG. 9 is a perspective view of a variable-pressure air pump in accordance with a second embodiment of the present invention.
Figure 10:
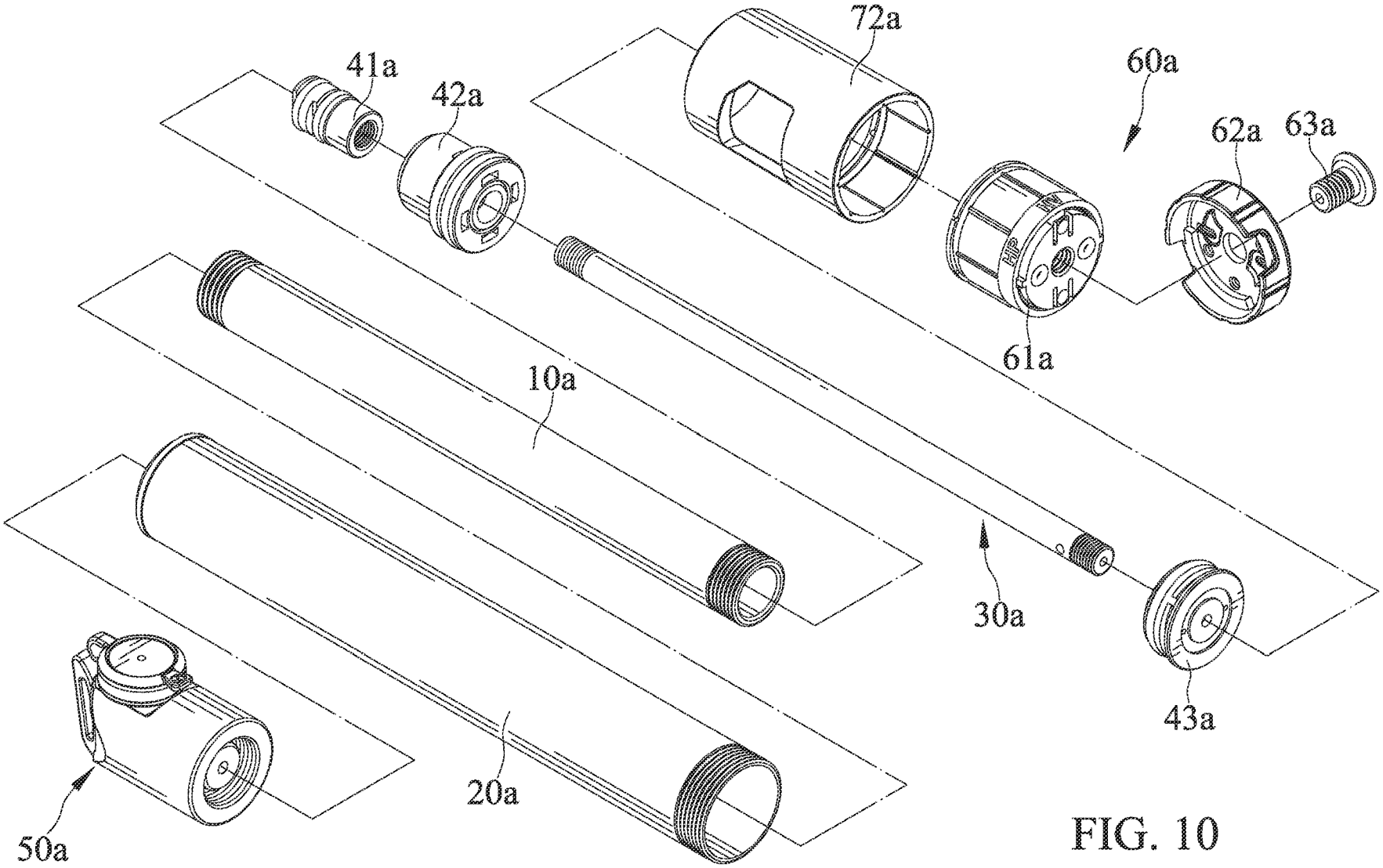
FIG. 10 is an exploded perspective view of the variable-pressure air pump of FIG. 9.
Figure 11:
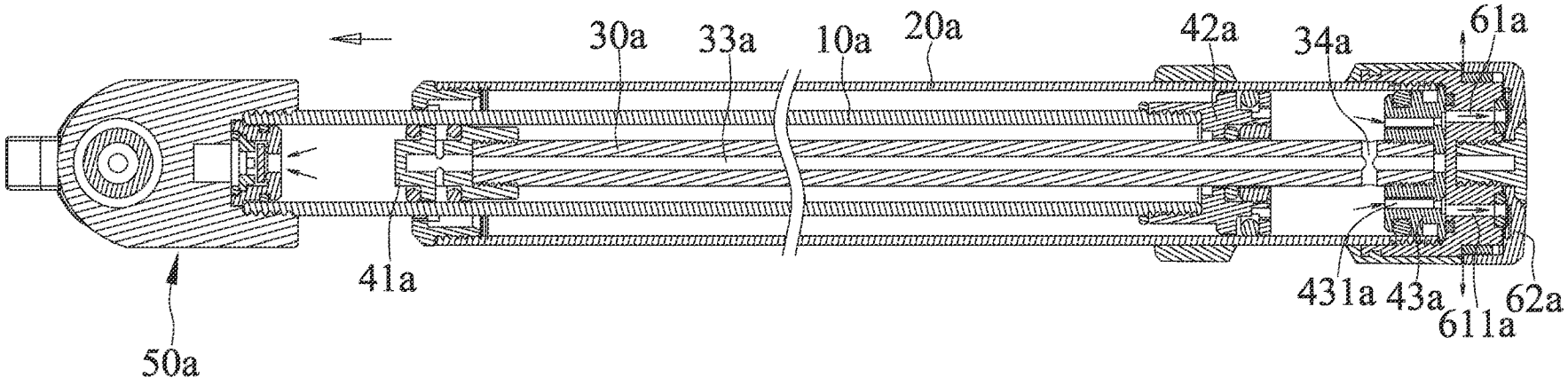
FIG. 11 is a cross-sectional view illustrating the operation of the variable-pressure air pump of FIG. 9, with a switch thereof in a first position.
Figure 12:
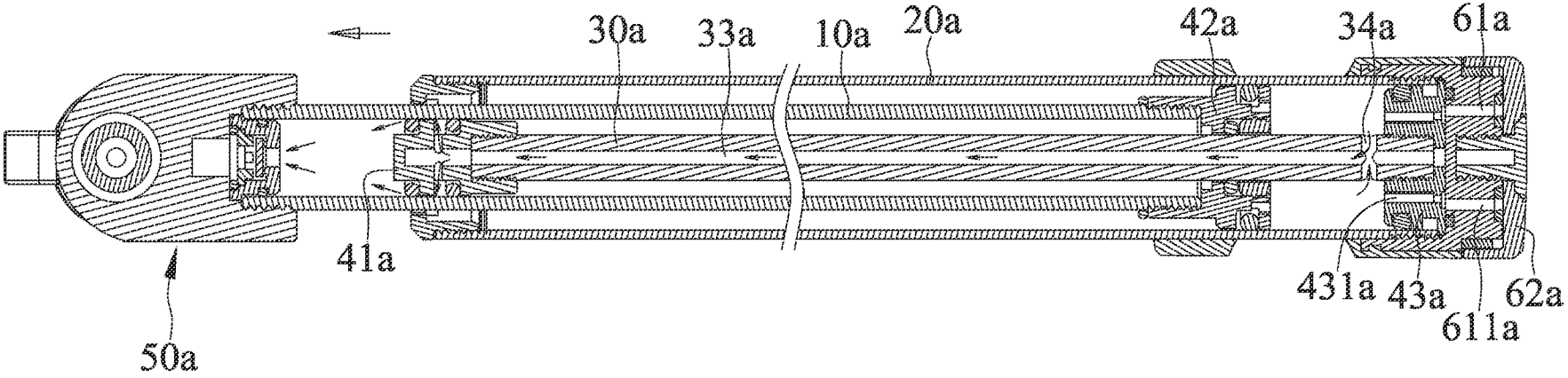
FIG. 12 a cross-sectional view illustrating the operation of the variable-pressure air pump of FIG. 9, with the switch thereof in a second position.

FIGS. 9-12 show a variable-pressure air pump in accordance with a second embodiment of the present invention, and the same numbers are used to correlate similar components of the first embodiment, but bearing a letter a. The second embodiment is similar to the first embodiment except the followings. A cylinder 10*a* inserted in a cylinder 20*a*. The cylinder 10*a* has a first end connected with a head assembly 50*a*. A plunger 30*a* is hollow and therefore defines a flow passage 33*a*. The plunger 30*a* also defines an orifice 34*a*, which extends radially therethrough, fluidly connecting with the flow passage 33*a*. The plunger 30*a* has a first end connected with a piston 41*a* and a second end connected with a connector 43*a*, which fluidly connects with a discharge device 60*a*, which is the same as the discharge device 60, an thus the descriptions are omitted for the sake of brevity. The connector 43*a* includes at least one discharge hole 431*a* fluidly connecting with at least one discharge hole 611*a* of a connecting member 61*a*. A piston 42*a* is connected at a second end of the cylinder 10*a*. Additionally, when a switch 62*a* of the discharge device 60*a*, which is movably connected with the connecting member 61*a* and fastened thereto by a fastener 63*a*, is moved to a first position which allows the pump to discharge air from the discharge hole 611*a*, air does not flow into the flow passage 33*a*. When the switch 62*a* is in the second position which does not allow the pump to discharge air from the discharge hole 611*a*, air flows into the flow passage 33*a*. A sleeve 72*a* connected with the cylinder 20*a*. The sleeve 72 is disposed adjacent to the discharge device 60*a*.

In view of the forgoing, when the variable-pressure air pump is operated with the switches 62 and 62*a* being in the first position, the variable-pressure air pump can discharge air to outside through the discharge holes 611 and 611*a*. In contrast, when the switches 62 and 62*a* are in the second position, the variable-pressure air pump cannot discharge air to outside through the discharge holes 611 and 611*a*.

The foregoing is merely illustrative of the principles of this invention, and various modifications can be made by those skilled in the art without departing from the scope and spirit of the invention.

What is claimed is:

1. A variable-pressure air pump comprising:

a first cylinder defining a first chamber;

a second cylinder movably connected with the first cylinder and defining a second chamber fluidly communicable with the outside of the variable-pressure air pump selectively;

a plunger having a first end inserted in first chamber and a second end inserted in the second chamber and defining a one-way flow passage fluidly connecting with the first and the second chambers;

a piston device configured to compress air in the first and the second chambers; and a discharge device including a connecting member and a switch movably connected with one another, wherein the connecting member defines at least one discharge hole fluidly connecting with the second chamber, wherein the switch has at least one flow guide portion fluidly connecting with the outside of the variable-pressure air pump and at least one blocking portion which is adapted to block the at least one discharge hole, wherein the switch is movable between a first position in which the at least one flow guide portion is adjacent and opens to the at least one discharge hole and a second position in which the at least one blocking portion is adjacent to and blocks the at least one discharge hole, wherein the discharge device is disposed at an end opposite to an end of a head assembly of the variable-pressure air pump, wherein the switch is fastened to the connecting member by a fastener, wherein the connecting member and the switch respectively defines a first hole and a second hole and the fastener is inserted through the second hole and engaged with the first hole, wherein the switch is rotatably connected with the connecting member, wherein the connecting member has two limits configured to obstruct movement of the switch, wherein the switch in the first position thereof is obstructed by one of the two limits, wherein the switch in the second position thereof is obstructed by the other of the two limits, and wherein the switch defines two grooves and the two limits are movably engaged in the two grooves respectively and move therein upon moving the switch with respect to the connecting member.

2. The variable-pressure air pump as claimed in claim 1, wherein the connecting member and the switch have a space therebetween filled by at least one seal, and wherein when the at least one blocking portion is adjacent to and blocks the at least one discharge hole, the at least one seal and the at least one blocking portion abut against one another.

3. The variable-pressure air pump as claimed in claim 2, wherein the at least one discharge hole has a small section and a large section and the at least one seal is retained in the large section.

4. The variable-pressure air pump as claimed in claim 1, wherein the head assembly includes a hose and a valve adapter fluidly connecting with one another, wherein the head assembly includes a head adapted to prevent air from flowing therethrough and out of the first chamber connected with the first cylinder, wherein the plunger is connected with the head, wherein the head defines a first compartment adapted to receive the valve adapter selectively and a second compartment with which the first end of the plunger is engaged, wherein the hose is retractable in the flow passage, and wherein the valve adapter is adapted to be disposed in the first compartment.

5. The variable-pressure air pump as claimed in claim 1, wherein the piston device includes a first piston configured to compress air in the first chamber and a second piston configured to compress air in the second chamber respectively.

6. The variable-pressure air pump as claimed in claim 5 further comprising a one-way flow device configured to allow air to flow in one direction and inhibit air passing through from flowing in an opposite direction, wherein the one-way flow device includes a first one-way valve disposed between the head and a wall delimiting the first chamber, and wherein the one-way flow device includes a second one-way valve disposed on the second piston and within the flow passage.

7. The variable-pressure air pump as claimed in claim 1 further comprising a sleeve disposed adjacent to the discharge device.

8. A variable-pressure air pump comprising:

a first cylinder defining a first chamber;

a second cylinder movably connected with the first cylinder and defining a second chamber fluidly communicable with the outside of the variable-pressure air pump selectively;

a plunger having a first end inserted the first chamber and a second end inserted in the second chamber and defining a one-way flow passage fluidly connecting with the first and the second chambers;

a piston device configured to compress air in the first and the second chambers, wherein the piston device includes a first piston configured to compress air in the first chamber and a second piston configured to compress air in the second chamber; and a discharge device including a connecting member and a switch movably connected with one another, wherein the connecting member defines at least one discharge hole fluidly connecting with the second chamber, wherein the switch has at least one flow guide portion fluidly connecting with the outside of the variable-pressure air pump and at least one blocking portion which is adapted to block the at least one discharge hole, wherein the switch is movable between a first position in which the at least one flow guide portion is adjacent and opens to the at least one discharge hole and a second position in which the at least one blocking portion is adjacent to and blocks the at least one discharge hole, wherein the discharge device is disposed at an end opposite to an end of a head assembly of the variable-pressure air pump;

wherein the plunger has a first end connected with the first piston and a second end connected with a connector which fluidly connects with the discharge device, and wherein the first cylinder has a first end connected with the head assembly and a second end connected with the second piston.

9. The variable-pressure air pump as claimed in claim 8, wherein the first piston is connected with the second cylinder and the second piston is connected with the plunger respectively.

* * * * *